US007484972B1

(12) United States Patent
Kuo et al.

(10) Patent No.: US 7,484,972 B1
(45) Date of Patent: Feb. 3, 2009

(54) ROTATABLE PLUG STRUCTURE WITH A FINGER HOLE

(75) Inventors: Ming-Chou Kuo, Taipei (TW); Yi-Ching Lin, Jhonghe (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/979,399

(22) Filed: Nov. 2, 2007

(30) Foreign Application Priority Data

Sep. 29, 2007 (TW) ..... 96136513 A

(51) Int. Cl.
*H01R 13/44* (2006.01)

(52) U.S. Cl. ..... 439/131

(58) Field of Classification Search ..... 439/131, 439/172, 174

See application file for complete search history.

(56) References Cited

U.S. PATENT DOCUMENTS 3,720,904 A * 3/1973 De Sio ..... 439/131
4,997,381 A * 3/1991 Oh ..... 439/172
5,108,315 A * 4/1992 Vogl et al. ..... 439/651
6,042,400 A * 3/2000 Queffelec et al. ..... 439/131
6,126,460 A * 10/2000 Wu ..... 439/131
6,261,109 B1 * 7/2001 Liu et al. ..... 439/131
6,312,271 B1 * 11/2001 Tseng ..... 439/131
6,544,051 B1 * 4/2003 Su ..... 439/131
7,104,813 B1 * 9/2006 Chuang ..... 439/131
7,125,266 B1 * 10/2006 Huang ..... 439/131
7,156,673 B2 * 1/2007 Son ..... 439/131
7,182,624 B1 * 2/2007 Miller ..... 439/369
7,287,991 B1 * 10/2007 Li ..... 439/131
2002/0151199 A1 * 10/2002 Yao ..... 439/131
2002/0173183 A1 * 11/2002 Segawa et al. ..... 439/131
2003/0068909 A1 * 4/2003 Su ..... 439/131
2003/0181082 A1 * 9/2003 Wu ..... 439/131
2004/0209500 A1 * 10/2004 Chang ..... 439/131
2005/0106908 A1 * 5/2005 Sakai ..... 439/131
2006/0019519 A1 * 1/2006 Son ..... 439/131

* cited by examiner

*Primary Examiner*—Hae Moon Hyeon
*Assistant Examiner*—Vladimir Imas
(74) *Attorney, Agent, or Firm*—Rosenberg, Klein & Lee

(57) ABSTRACT

A rotatable plug includes a plug body, a rotatable base and at least two conductive terminals. One end of the plug body has an accommodating space. The plug body is provided with a penetrating hole to make the plug body to form a hollow annular body. The rotatable base is rotatably provided in the accommodating space of the plug body. The two conductive terminals are provided on the rotatable base. The two conductive terminals rotate together with the rotatable base to the outside of the plug body or are accommodated in the plug body. Via this arrangement, the conductive terminals can be avoided from getting inclined or suffering damage by the impact or compression during transportation. Further, it is convenient for the user to put his/her finger in the hollow annular body to pull out the plug.

6 Claims, 2 Drawing Sheets

ROTATABLE PLUG STRUCTURE WITH A FINGER HOLE

BACKGROUND OF THE INVENTION

1. Field of the Invention

The present invention relates to a rotatable plug, and in particular to a rotatable plug which has rotatable conductive terminals for conducting the electricity to electrical appliances.

2. Description of Related Art

The conventional plug is used to conduct the electricity to various kinds of electrical appliances. The increase of electrical appliances makes the plug to be used more frequently. The manufacturer also aims to improve the plug continuously to make the functions of the plug more perfect. The current plug is rotatable and can rotate to different angles based on the practical demands, so that it is more convenient to connect and use. For example, Taiwan Patent Publication No. 431695 published on 21 Apr. 2001 discloses an improved rotatable plug, which is constituted of a base, a roller, two conductive terminals, two fixing terminals, a lead and an upper cover. The front end of the base is provided with a lower roller hole. The lower roller hole provided underneath the base allows a roller to be disposed therein exactly. Both sides of the roller are provided with a terminal trough respectively. The front end of the conductive terminal is provided with a penetrating hole. A pivoting portion extends from the distal end of the conductive terminal. The pivoting portion provided at the distal end of the conductive terminal can be lodged in the terminal trough of the roller exactly. The fixing terminal is pivoted to the pivoting portion provided at the distal end of the conductive terminal. The upper cover is provided with an upper roller hole to correspond to the roller. When the upper cover is covered on the base, the roller can be held and rotate between the upper roller hole of the upper cover and the lower roller hole of the base. This patent document is characterized in that a clamping portion extends from the distal end of the fixing terminal with the clamping portion of the fixing terminal being connected to the lead, thereby making the whole profile of the fixing terminals to match that of the conductive terminals.

However, in the above-mentioned conventional rotatable plug, the conductive terminals cannot be accommodated in the plug body. In addition to occupy a space, the conductive terminals may get inclined or suffer damage by impact or compression during transportation, so that personnel may suffer injury. Further, like a common plug, the above-mentioned conventional rotatable plug cannot be pulled out easily.

Therefore, in view of the above the drawbacks, the inventor proposes the present invention to overcome the above problems based on his deliberate research.

SUMMARY OF THE INVENTION

The primary object of the present invention is to provide a rotatable plug, whereby the conductive terminals thereof can be avoided from getting inclined or suffering damage by the impact or compression during transportation, and thus personnel can be avoided from suffering injury.

The another object of the present invention is to provide a rotatable plug, in which a plug body is formed into a hollow annular body, thereby allowing a user to put his/her finger therein and pull out the plug from the socket. The user can use his/her finger to pull out the conductive terminals accommodated in the plug body. When the conductive terminals are not in use, the conductive terminals can be pushed into the plug body, thereby saving the space.

In order to achieve the above object, the present invention provides a rotatable plug including: a plug body having an accommodating space at an end thereof, the plug body being provided with a penetrating hole to make the plug body to form a hollow annular body; a rotatable base rotatably provided in the accommodating space of the plug body; at least two conductive terminals provided on the rotatable base, the two conductive terminals rotating together with the rotatable base to extend from the plug body or being accommodated in the plug body.

The present invention has the following effect. The rotatable base and the conductive terminals of the present invention can be rotatably provided in the plug body, the rotatable base and the conductive terminals can rotate to the outside of the plug body and thus can be applied to a socket. Further, the rotatable base and the conductive terminals can be accommodated in the penetrating hole of the plug body. Therefore, the conductive terminals can be avoided from getting inclined or suffering damage by the impact or compression during transportation. Further, after the conductive terminals are accommodated in the plug body, the personnel can be avoided from suffering injury.

Further, the plug body of the present invention is provided with a penetrating hole, so that the plug body is formed into a hollow annular body. Therefore, it is convenient for the user to put his/her finger in the penetrating hole to pull out the plug. Further, the user can use his/her finger to pull out the conductive terminals disposed in the penetrating hole. When the conductive terminals are not in use, they can be pushed back into the penetrating hole, thereby saving the space.

In order to further understand the characteristics and the technical contents of the present invention, a detailed description will be made with reference to the accompanying drawings. However, the drawings are illustrative only but not used to limit the present invention.

DETAILED DESCRIPTION OF THE PREFERRED EMBODIMENTS

Figure 1:
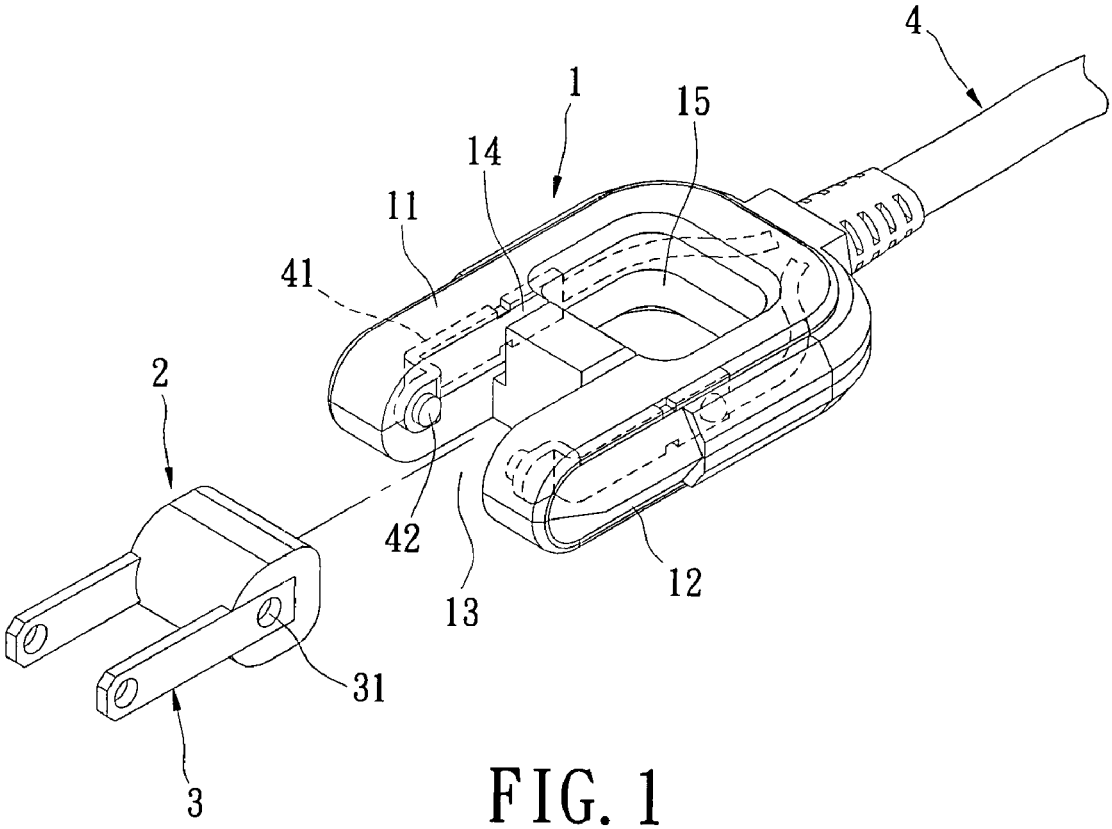
FIG. 1 is an exploded perspective view showing the rotatable plug of the present invention.

Please refer to FIGS. 1 to 4. The present invention provides a rotatable plug including a plug body 1, a rotatable base 2, at least two conductive terminals 3 and a wire 4. The plug body 1 is made of an insulating material and comprises a first casing 11 and a second casing 12. The first casing 11 and the second casing 12 can be combined with each other by means of locking, screwing or supersonic wave, thereby forming a hollow plug body 1.

The front end of the plug body 1 is formed with an accommodating space 13. The accommodating space 13 allows the rotatable base 2 to be disposed therein exactly. The accommodating space 13 penetrates the front end, the top surface and the bottom surface of the plug body 1. The accommodating space 13 of the plug body 1 extends rearward to form at least two storage grooves 14. In other word, the plug body 1 has at least two storage grooves 14 communicating with the accommodating space 13. The two storage grooves 14 correspond to the two conductive terminals 3. The two storage grooves 14 are in communication with the accommodating space 13. The center of the plug body 1 is provided with a penetrating hole 15. The penetrating hole 15 penetrates the top surface and bottom surface of the plug body 1. Via this design, the plug body 1 can be formed into a hollow annular body.

The rotatable base 2 is made of an insulating material. The rotatable base 2 is a base corresponding to the accommodating space 13 of the plug body 1. The rotatable base 2 is rotatably provided in the accommodating space 13 of the plug body 1.

The conductive terminals (also referred to as terminals, conductive pieces or copper pieces) 3 are made of steel materials having good conductivity. The shape and the construction of the conductive terminal are not limited to the illustrative embodiment only, but can be suitably varied according to the demands. The number of the conductive terminals can be two or three. In the present embodiment, there are two conductive terminals 3. The two conductive terminals 3 are fixedly provided on both sides of the rotatable base 2. The front ends of the two conductive terminals 3 protrude from the front end of the rotatable base 2 to a proper length, so that the conductive terminals can be inserted into corresponding insertion holes of a socket. The two conductive terminals 3 rotate in synchronization with the rotatable base 2, so that the two conductive terminals can rotate to the outside of the plug body 1 or be accommodated in the two storage grooves 14 and the penetrating hole 15 of the plug body 1.

One end of the wire 4 is connected to the rear end of the plug body 1. The wire 4 penetrates into the plug body 1, thereby connecting electrically to the two conductive terminals 3. In the present embodiment, one end of the wire 4 is connected with at least two conductive pieces 41. The two conductive pieces 41 are provided in the plug body 1. The rear ends of the two conductive terminals 3 are provided with a pivoting hole 31 respectively. The pivoting holes 31 of the two conductive terminals 3 are pivoted to the two conductive pieces 41 respectively via pivoting pieces 42, so that the two conductive terminals 3 are brought into contact and electrical connection with the two conductive pieces 41. Further, the two conductive terminals 3 and the rotatable base 2 are pivoted to the two conductive pieces 41, so that the rotatable base 2 and the two conductive terminals 3 can be rotatably provided in the plug body 1. Via the above arrangement, the rotatable plug of the present invention can be obtained.

Figure 2:
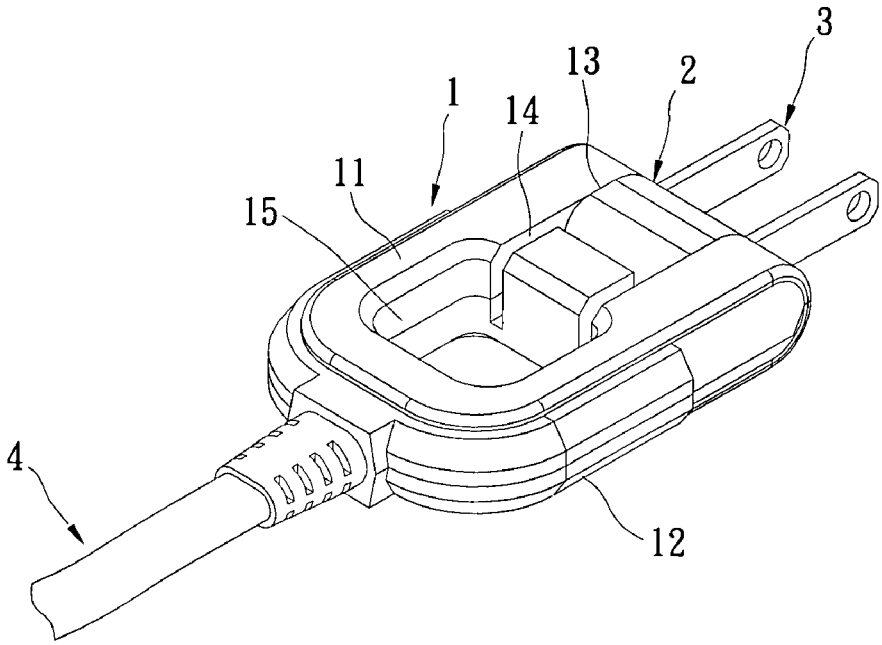
FIG. 2 is a perspective view showing the rotatable plug of the present invention in a first operating state.
Figure 3:
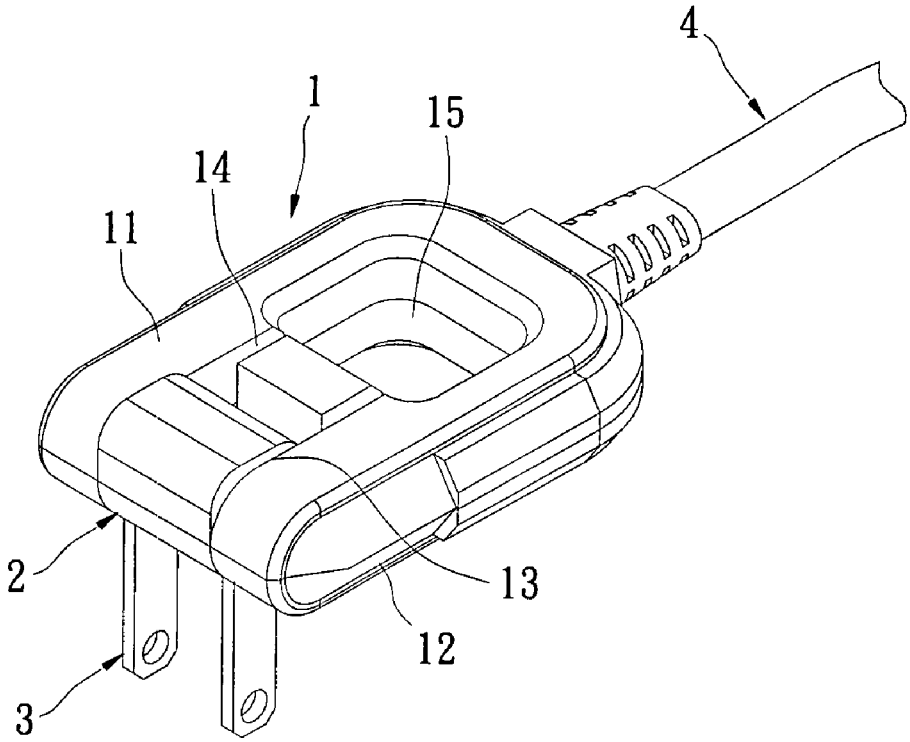
FIG. 3 is a perspective view showing the rotatable plug of the present invention in a second operating state.
Figure 4:
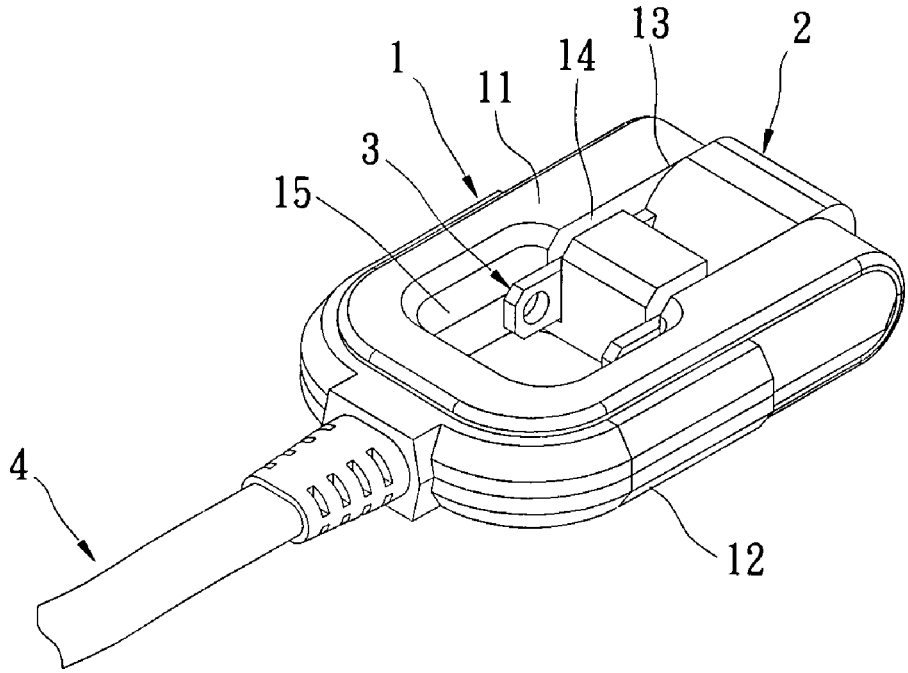
FIG. 4 is a perspective view showing the rotatable plug of the present invention in a third operating state.

Please refer to FIGS. 2 to 4. Since the rotatable base 2 and the conductive terminals 3 of the present invention are rotatably provided in the plug body 1, the rotatable base 2 and the conductive terminals 3 can rotate 270 degrees. In addition to a normal rotation of 180 degrees for a socket (FIGS. 2 and 3), they can rotate more 90 degrees to facilitate the conductive terminals 3 to be accommodated in the storage grooves 14 and the penetrating hole 15 of the plug body 1 (FIG. 4). Via this arrangement, the conductive terminals 3 can be avoided from getting inclined or suffering damage by the impact or compression during transportation. Further, after the conductive terminals 3 are accommodated in the plug body 1, the personnel can be avoided from suffering injury.

Further, the plug body 1 of the present invention is provided with a penetrating hole 15, so that the plug body 1 is formed into a hollow annular body. Therefore, it is convenient for the user to put his/her finger in the penetrating hole 15 to pull out the plug. Further, the user can use his/her finger to pull out the conductive terminals 3 disposed in the penetrating hole 15. When the conductive terminals 3 are not in use, they can be pushed back into the storage grooves 14 and the penetrating hole 15, thereby saving the space.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A rotatable plug structure, comprising:

a plug body, one end of the plug body having an accommodating space, the plug body being provided with a penetrating hole to make the plug body form a hollow annular body, the plug body having at least two storage grooves communicating with the accommodating space;

a rotatable base rotatably disposed in the accommodating space of the plug body; and at least two conductive terminals provided on the rotatable base, the two conductive terminals rotating together with the rotatable base to extend from the plug body or being received in the plug body, and the two storage grooves and the penetrating hole being used to accommodate the two conductive terminals.

2. A rotatable plug structure according to claim 1, wherein the other end of the plug body is connected with a wire, one end of the wire penetrates into the plug body and is connected electrically to the two conductive terminals.

3. A rotatable plug structure according to claim 2, wherein one end of the wire has at least two conductive pieces, the two conductive pieces are disposed inside the plug body, the two conductive terminals are pivoted to the two conductive pieces via pivoting pieces, so that the two conductive terminals are brought into contact and electrical connection with the two conductive pieces.

4. A rotatable plug structure according to claim 1, wherein the plug body comprises a first casing and a second casing, the first casing and the second casing constitute one body.

5. A rotatable plug structure according to claim 1, wherein the penetrating hole penetrates one end, top surface and bottom surface of the plug body.

6. A rotatable plug structure according to claim 1, wherein the two conductive terminals are disposed on two lateral surfaces of the rotatable base.

* * * * *